US010906095B2

(12) United States Patent
Persson

(10) Patent No.: US 10,906,095 B2
(45) Date of Patent: Feb. 2, 2021

(54) MOULD FOR MANUFACTURING MOULD STEELS

(71) Applicant: UDDEHOLMS AB, Hagfors (SE)

(72) Inventor: Eva Sjoqvist Persson, Hagfors (SE)

(73) Assignee: UDDEHOLMS AB, Hagfors (SE)

( * ) Notice: Subject to any disclaimer, the term of this patent is extended or adjusted under 35 U.S.C. 154(b) by 202 days.

(21) Appl. No.: 16/074,015

(22) PCT Filed: Jan. 27, 2017

(86) PCT No.: PCT/SE2017/050073
§ 371 (c)(1),
(2) Date: Jul. 30, 2018

(87) PCT Pub. No.: WO2017/142455
PCT Pub. Date: Aug. 24, 2017

(65) Prior Publication Data

US 2019/0039127 A1 Feb. 7, 2019

(30) Foreign Application Priority Data

Feb. 16, 2016 (SE) ..... 1650203

(51) Int. Cl.

| | |
|---|---|
| ***B22D 23/10*** | (2006.01) |
| ***C22B 9/18*** | (2006.01) |
| ***B22D 7/06*** | (2006.01) |
| ***B22D 7/00*** | (2006.01) |

(52) U.S. Cl.
CPC ..... *B22D 23/10* (2013.01); *B22D 7/00* (2013.01); *B22D 7/06* (2013.01); *C22B 9/18* (2013.01)

(58) Field of Classification Search
CPC .. B22D 23/10; B22D 7/00; B22D 7/06; C22B 9/18
USPC ..... 373/139, 140, 141, 142, 144, 145, 153, 373/154, 155, 42, 88
See application file for complete search history.

(56) References Cited

U.S. PATENT DOCUMENTS

| | | | |
|---|---|---|---|
| 4,953,177 A | 8/1990 | Tommaney et al. | |
| 2013/0336353 A1 | 12/2013 | Krepel et al. | |

FOREIGN PATENT DOCUMENTS

| | | | | |
|---|---|---|---|---|
| CN | 201400710 | * | 2/2010 | ..... C22B 9/193 |
| CN | 201400710 Y | | 2/2010 | |
| CN | 201459215 U | | 5/2010 | |
| CN | 104388689 A | | 3/2015 | |
| GB | 536470 A | | 5/1941 | |

(Continued)

OTHER PUBLICATIONS

Holzgruber, W., "Overview of 50 Years of Development in Electroslag Remelting in Austria," Berg-und Huttenmannische Monatshefte, vol. 161, S2-S11 (2016).

(Continued)

*Primary Examiner* — Phuong T Nguyen
(74) *Attorney, Agent, or Firm* — Karceski IP Law, PLLC

(57) ABSTRACT

The invention relates to a mould for the manufacturing of mould steels in an inert gas or a pressurized electro slag re-melting apparatus. The mould comprises a non-rectangular and non-circular inner copper sleeve having a width, w, of 1000-2500 mm and a thickness, t, of 700-1250 mm, wherein the short sides in the thickness direction of the copper sleeve at least partly have sections with curved surfaces and wherein the long sides in the width direction at least partly have sections with curved surfaces.

12 Claims, 1 Drawing Sheet

(56) References Cited

FOREIGN PATENT DOCUMENTS

| | | | |
|---|---|---|---|
| JP | 613651 | | 1/1986 |
| JP | S6336965 | A | 2/1988 |
| JP | 2012241230 | A | 12/2012 |
| RU | 2026147 | C1 | 1/1995 |
| SU | 816161 | A1 | 11/1991 |
| SU | 1788770 | A3 | 3/1995 |
| WO | WO-9920804 | A1 | 4/1999 |

OTHER PUBLICATIONS

International Search Report for International Application No. PCT/SE2017/050073, dated Apr. 5, 2017.
Extended European Search Report for Application No. EP 17753570.5, dated Dec. 18, 2018.
Database WPI Week 201016, Thomson Scientific, London, GB; AN 2010-B96540, XP-002787050, 2017 Clarivate Analytics.
Database WPI Week 201036, Thomson Scientific, London, GB; AN 2010-F82585, XP-002787501, 2017 Clarivate Analytics.
Office Action corresponding in Chinese Application No. 201780010110.8 dated Jul. 30, 2019. (English Translation).
Russian Office Action dated Mar. 25, 2020, for Russian Patent Application No. 2018130152/02(048819).
Russian Search Report dated Mar. 25, 2020, for Russian Patent Application No. 2018130152/02(048819).
Japanese Notice of Reasons for Rejection dated Sep. 17, 2020, for Japanese Patent Application No. 2018-536771.

* cited by examiner

MOULD FOR MANUFACTURING MOULD STEELS

TECHNICAL FIELD

The invention relates to a mould for the manufacturing of mould steels in an Inertgas Electro Slag Remelting (IESR) or a Pressurized Electro Slag Remelting (PESR) process.

BACKGROUND ART

Mould steels are used for making moulds and dies for the manufacturing of light metal or plastic articles. Electro Slag Remelting (ESR) is commonly used in order to minimize segregation and to reduce the amount of non metallic inclusions of the remelted material. The cleanliness and homogeneity of ESR ingots result in improved mechanical properties as compared to conventionally cast material. The conventional ESR is performed without isolation of the atmosphere.

In recent years the protective gas methods Inertgas Electro Slag Remelting (IESR) and Pressurized Electro Slag Remelting (PESR) have gained a considerable interest, since these methods eliminate the risk of picking up hydrogen and oxygen from the atmosphere and result in a further reduction of the amount of non metallic inclusions in the remelted material.

However, it has now been recognized, that large ingots produced by IESR and PESR do not have the same high cleanliness as compared to smaller ingots. This problem is important, in particular for ingots having diameters exceeding 1000 mm, in particular in view of the increased demand for large sized moulds and dies.

SUMMARY OF THE INVENTION

The general objective of the present invention is to provide a mould for the manufacturing of large sized mould steel ingots with an improved cleanliness and/or an improved microstructure in an Inertgas Electro Slag Remelting (IESR) or in a Pressurized Electro Slag Remelting (PESR) process.

Another object is to provide an IESR or PESR apparatus comprising the improved large size mould. A further object is to provide a steel ingot obtainable with the inventive IESR or PESR and thereby having an improved cleanliness and/or an improved microstructure.

These objects are achieved by the means of the invention as defined in the independent claims.

BRIEF DESCRIPTION OF THE DRAWINGS

In the following, the invention will be described in more detail with reference to the preferred embodiments and the appended drawings.

DETAILED DESCRIPTION

The invention is defined in the claims.

The present inventor has surprisingly found that the cleanliness of the refined mould steel can be influenced by changing the shape of the mould. By replacing the conventional round mould nowadays used in IESR and PESR by a mould having an improved shape, it is possible to further improve the cleanliness and the microstructure of the remelted ingot.

The inventive mould comprises a non-rectangular and non-circular inner copper sleeve having a width, w, of 1000-2500 mm and a thickness, t, of 700-1250 mm, wherein the short sides in the thickness direction of the copper sleeve at least partly have sections with curved surfaces and wherein the long sides in the width direction at least partly have sections with curved surfaces.

The invention will be described in detail with reference to the attached drawings.

Figure 1:
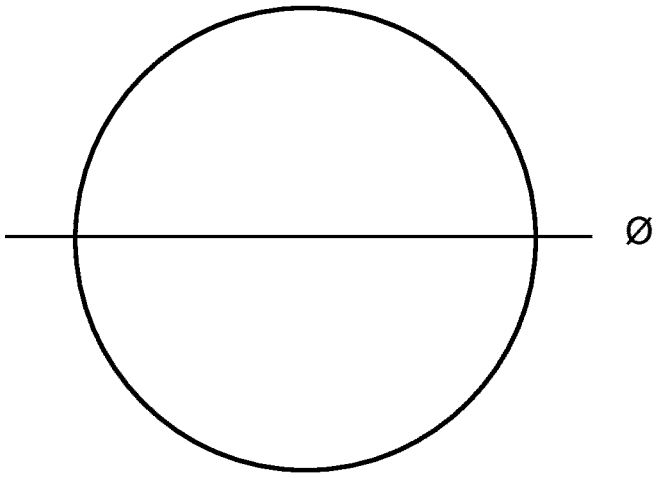
Fig. 1 PRIOR ART
FIG. 1 is a schematic drawing of the cross section of a conventional mould having a diameter of 1250 mm and having an area of 0.39 $m^2$.

FIG. 1 discloses the cross section of a conventional mould having a diameter, d, of 1250 mm and an area of 0.39 $m^2$.

Figure 2:
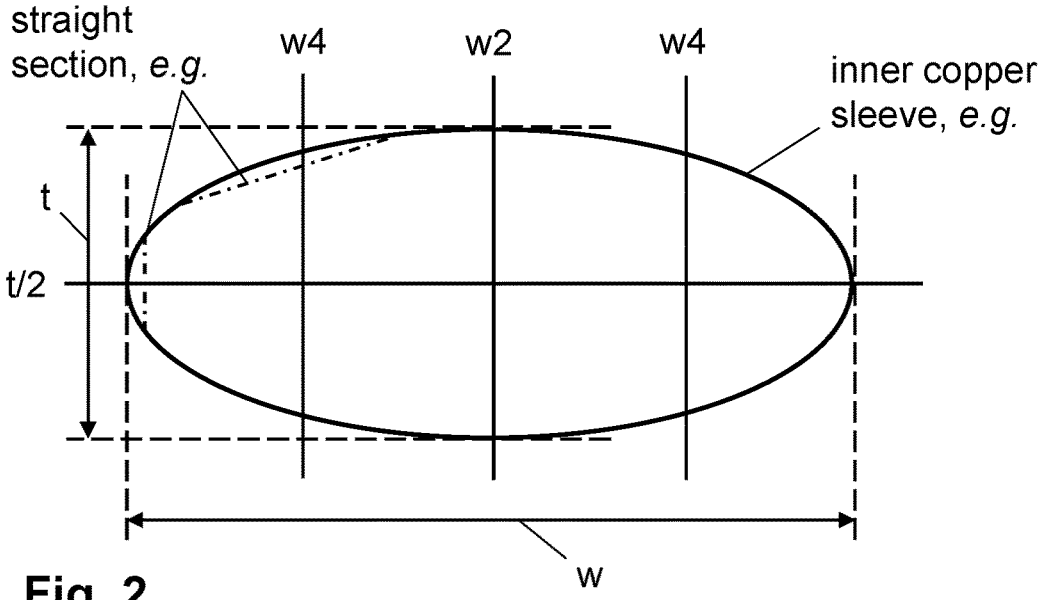
FIG. 2 is a schematic drawing of one embodiment of the present invention showing the cross section of an elliptical mould having the same area as the conventional mould.

FIG. 2 discloses the cross section of an inventive mould having the same area as the conventional mould but having an elliptical shape. The thickness of the mould was chosen to be 800 mm, wherein the width of the elliptical mould was 1953 mm.

Both figures relate to the size of the inner sleeve of the mould, which size, except for the solidification shrinkage, corresponds to the size of the remelted ingot.

According to the invention, the mould can have different shapes. However, the short sides, in the thickness direction of the copper sleeve, as well as the long sides, in the width direction, both have, at least partly, sections with curved surfaces.

The short sides and the long sides may have sections that are straight.

The short sides may optionally be provided with straight sections, which are positioned in the mid portions of the short sides, i.e. at t/2. The short sides may be designed to have a constant radius of curvature (arc shaped) or having a variable radius of curvature (e.g. oval-, elliptical- or super elliptical-shaped). The radius of curvature can extend to any desired point up to the position w/4.

The long sides may have only one straight section or more than one straight section on each side. Two straight sections may be formed on each long side, in particular in the sections w/8 to w/2 and may have a smooth transition at w/2.

The mid thickness of the mould at w/2 may be the same as the thickness at the quarter thickness of the mould at w/4 from each short side of the mould. However, it is normally preferred, that the mid thickness of the mould at w/2 is at least 10 mm thicker than the quarter thickness at w/4 of the mould from each short side of the mould. The thickness at w/2 may be 20, 40, 60, 80, 100, 120, 140, 160 or 180 mm larger than the thickness at w/4.

The sections with curved surfaces of the short sides can have a constant or a variable radius of curvature. The short sides may have a constant or variable radius of curvature up to the position w/4. The mould can have an oval, elliptical or super-elliptical form and/or the width of the mould, w, may be at least 1.1 times larger than the thickness, t, preferably w>1.2t.

The size of the mould can be freely varied within the ranges set out in claim 1. The width can be restricted to 2400, 2300, 2200, 2100, 2000, 1900, 1800, 1700, 1600, 1500, 1400, 1300, 1200 or 1100 mm. The thickness can be restricted to 1200, 1150, 1000, 950, 900, 850, 800 or 750 mm. The width is always larger than the thickness.

Example

A plastic mould steel was produced by conventional EAF steelmaking followed by ladle metallurgy, vacuum degassing and casting into electrodes having suitable diameters for the remelting in the respective PESR. The moulds are schematically shown in FIGS. 1 and 2. The remelting was performed with the same type of slag based on CAF-CaO—$Al_2O_3$ under argon protective atmosphere. Samples were taken from the centre of the forged and heat treated material at the same height of the respective ingot. The samples were cut, cold mounted, grinded and polished and thereafter subjected to examination in a Light Optical Microscope (LOM). The number of inclusions per $mm^2$ in the respective ingot was examined. Only inclusions larger than 8 μm were counted.

It was found, that the number of inclusions per $mm^2$ could be reduced by changing the thickness of the mould. The reason for this result is presently not fully understood and the inventor does not wish to be bound by any theory. However, it would appear, that the positive result may be influenced by a number of factors such as a different turbulent flow in the slag and in the molten pool, a less deep metal pool and/or by more favourable solidification conditions, leading to a reduction of the solidification time of the ingot and a reduced amount or complete absence of equiaxed crystals in the remelted ingot.

INDUSTRIAL APPLICABILITY

The invention is particularly suited for the manufacturing of large sized dies in hot work tool steel for die casting of light alloys as well as for the manufacturing of large sized plastic mould steel moulds used for the moulding of plastics articles.

The invention claimed is:

1. A mould for the manufacturing of mould steels in an inert gas or a pressurized electro slag re-melting process, characterized in that the mould comprises a non-rectangular and non-circular inner copper sleeve having a width, w, of 1000-2500 mm and a thickness, t, of 700-1250 mm, wherein the short sides in the thickness direction of the inner copper sleeve, at least partly, have sections with curved surfaces and wherein the long sides in the width direction, at least partly, have sections with curved surfaces.

2. The mould according to claim 1, wherein the curved surfaces of the short sides have a constant radius of curvature.

3. The mould according to claim 1, wherein the curved surfaces of the short sides have a variable radius of curvature.

4. The mould according to claim 3, wherein the mould has an oval, elliptical or super-elliptical form.

5. The mould according to claim 3, wherein the curved surfaces of the short sides have straight sections.

6. The mould according to claim 1, wherein the mid thickness of the mould at w/2 is the same as the thickness at the quarter thickness of the mould at w/4 from both short sides of the mould.

7. The mould according to claim 1, wherein the mid thickness of the mould at w/2 is at least 10 mm thicker than the quarter thickness at w/4 of the mould from both short sides of the mould.

8. The mould according to claim 1, wherein the mould has a width of 1500-2000 mm and/or a thickness of 800-1050 mm.

9. The mould according to claim 1, wherein the long sides have at least one straight section.

10. The mould according to claim 1, wherein the inner copper sleeve does not have any welding seams.

11. An Inertgas Electro Slag Remelting or a Pressurized Electro Slag Remelting apparatus characterized in that it is provided with a mould according to claim 1.

12. An ESR remelted tool steel ingot for making moulds or dies, characterized in that the steel ingot is obtainable with an apparatus as defined in claim 11, wherein the steel ingot is non-rectangular and non-circular and has a width, w, of 1000-2500 mm and a thickness, t, of 700-1250 mm and wherein the short sides in the thickness direction of the ingot, at least partly, have sections with curved surfaces and wherein the long sides in the width direction, at least partly, have sections with curved surfaces.

* * * * *